US006354918B1

(12) United States Patent
Togawa et al.

(10) Patent No.: US 6,354,918 B1
(45) Date of Patent: Mar. 12, 2002

(54) APPARATUS AND METHOD FOR POLISHING WORKPIECE

(75) Inventors: Tetsuji Togawa, Chigasaki; Nobuyuki Takada, Fujisawa; Seiji Katsuoka, Atsugi; Kenichi Shigeta, Yokohama, all of (JP)

(73) Assignees: Ebara Corporation, Tokyo; Kabushiki Kaisha Toshiba, Kanagawa-Ken, both of (JP)

( * ) Notice: Subject to any disclaimer, the term of this patent is extended or adjusted under 35 U.S.C. 154(b) by 0 days.

(21) Appl. No.: 09/335,778

(22) Filed: Jun. 18, 1999

(30) Foreign Application Priority Data

Jun. 19, 1998 (JP) ..... 10-189703

(51) Int. Cl.[7] ..... B24B 1/00
(52) U.S. Cl. ..... 451/56; 451/283; 451/443
(58) Field of Search ..... 451/56, 283, 285, 451/286, 443

(56) References Cited

U.S. PATENT DOCUMENTS 5,738,574 A 4/1998 Tolles
6,019,670 A * 2/2000 Cheng et al.
6,036,583 A * 3/2000 Perlov et al.
6,099,393 A * 8/2000 Katagiri et al.
6,116,997 A * 9/2000 Hakomori et al.

FOREIGN PATENT DOCUMENTS

JP 63-68360 3/1988
JP 2-65966 3/1990

* cited by examiner

*Primary Examiner*—Joseph J. Hail, III
*Assistant Examiner*—Willie Berry, Jr.
(74) *Attorney, Agent, or Firm*—Wenderoth, Lind & Ponack, L.L.P.

(57) ABSTRACT

A polishing apparatus has a turntable with a polishing surface, a top ring for pressing a workpiece against the polishing surface under a given pressure to polish the workpiece, and a dresser for dressing the polishing surface. The polishing surface has an outer circumferential edge portion cut off or the dresser has a predetermined outside diameter, such that the polishing surface has an outer circumferential edge positioned in alignment with or radially inwardly of an outer circumferential edge of the dresser in the radial direction of the turntable when the polishing surface is dressed by the dresser.

9 Claims, 5 Drawing Sheets

APPARATUS AND METHOD FOR POLISHING WORKPIECE

BACKGROUND OF THE INVENTION

1. Field of the Invention

The present invention relates to a polishing apparatus and method, and more particularly to an apparatus and method for polishing a workpiece such as a semiconductor wafer to a flat mirror finish.

1. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small. However, conventional apparatuses for planarizing semiconductor wafers such as self-planarizing CVD apparatus or etching apparatus fail to produce completely flat surfaces on semiconductor wafers. Recently, it has been attempted to planarize semiconductor wafers with a polishing apparatus which is expected to achieve complete planarization of the semiconductor wafers with greater ease than the above conventional apparatuses. Such a process is called Chemical Mechanical Polishing (CMP) in which the semiconductor wafers are chemically and mechanically polished while supplying an abrasive liquid comprising abrasive grains and chemical solution such as alkaline solution.

Conventionally, such a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains (or material) is supplied onto the polishing cloth and retained on the polishing cloth. During operation, the top ring exerts a certain pressure on the turntable, and the surface of the semiconductor wafer held against the polishing cloth is therefore polished by a combination of chemical polishing and mechanical polishing to a flat mirror finish while the top ring and the turntable are rotated.

In the polishing apparatus for polishing the surface of a semiconductor wafer, especially a device pattern on the upper surface of a semiconductor wafer, to a planar finish a polishing cloth attached to a turntable made of nonwoven fabric has heretofore been employed.

Higher levels of integration achieved in recent years for ICs and LSI circuits demand smaller steps or surface irregularities on the polished surface of the semiconductor wafer. In order to meet such a demand, it has been proposed to employ a polishing cloth made of a hard material such as polyurethane foam.

After the semiconductor wafers are contacted with the polishing cloth and polished by rotating the turntable and the top ring which holds the semiconductor wafer, the polishing capability of the polishing cloth is gradually deteriorated due to a deposit of abrasive grains and groundoff particles of the semiconductor material, and due to changes in the characteristics of the polishing cloth. Therefore, if the same polishing cloth is used to repeatedly polish semiconductor wafers, the polishing rate of the polishing apparatus is lowered, and the polished semiconductor wafers tend to suffer polishing irregularities. Therefore, it has been customary to condition the polishing cloth according to a process called "dressing" for recovering the surface of the polishing cloth before, or after, or during polishing.

One way of dressing a polishing cloth made of a hard material such as polyurethane foam is to use a diamond dresser. The diamond dresser is advantageous in that it is effective to recover the desired polishing surface of the polishing cloth and does not cause a lowering of the polishing rate.

When the diamond dresser dresses the polishing surface of the polishing cloth, it scrapes a thin layer off the polishing cloth. Since the diamond dresser dresses only a limited inner area of the polishing cloth which is used for polishing semiconductor wafers, and slightly marginal areas located inside and outside of the limited area, the polishing surface of the polishing cloth becomes irregular, i.e., loses its planarity, after it has been dressed many times. As a result, an annular step of certain width is formed on the polishing surface along an outer circumferential edge of the polishing cloth and has an upper surface higher than the upper surface of the dressed inner area.

After a semiconductor wafer is polished with the polishing cloth thus dressed, it is necessary to remove the semiconductor wafer from the polishing cloth. However, if the top ring holding the semiconductor wafer is raised to remove the semiconductor wafer from the polishing cloth, the surface tension between the polishing cloth and the semiconductor wafer is large, and there are some cases that only the top ring is raised and the semiconductor wafer adheres to the polishing cloth to be left on the polishing cloth.

SUMMARY OF THE INVENTION

It is therefore an object of the present invention to provide a polishing apparatus and method which: have an overhanging function to remove a workpiece such as a semiconductor wafer from a polishing surface of a polishing cloth after a polished surface of the workpiece is partly exposed beyond the outer circumferential edge of the polishing cloth in overhanging relation thereto; can prevent the workpiece from cracking when the workpiece is in the over state; and can also prevent an unexpected remaining mark from being formed on the polished surface of the workpiece.

According to one aspect of the present invention, there is provided an apparatus for polishing a surface of a workpiece, comprising: a turntable having a polishing surface thereon; a top ring for holding a workpiece and pressing the workpiece against the polishing surface under a given pressure to polish the workpiece; a mechanism for moving the top ring in a horizontal plane while the workpiece is in contact with the polishing surface to project a part of polished surface of the workpiece from the polishing surface after polishing, and then raising the top ring holding the workpiece to remove the workpiece from the polishing surface; and a dresser for dressing the polishing surface. The dresser dresses the polishing surface from an inner side to an outer circumferential edge of the polishing surface so that a step is not formed from an area located at the inner side of the polishing surface and used for polishing the workpiece to the outer circumferential edge of the polishing surface.

According to another aspect of the present invention, there is also provided a method for polishing a surface of a workpiece, comprising: dressing a polishing surface of a turntable from an inner side to an outer circumferential edge of the polishing surface so that a step is not formed from an area located at the inner side of the polishing surface and used for polishing the workpiece to the outer circumferential edge of the polishing surface; holding the workpiece and pressing the workpiece against the polishing surface under a given pressure by a top ring; and moving the top ring in a horizontal plane while the workpiece is in contact with the polishing surface to project a part of polished surface of the workpiece from the polishing surface after polishing, and then arising the top ring holding the workpiece to remove the workpiece from the polishing surface.

According to the present invention, when the polishing surface on the turntable is dressed, it is dressed to its outer circumferential edge by the dresser to thereby minimize or eliminate formation of a step. Therefore, when the polished workpiece is horizontally displaced to a position where a polished surface of the workpiece is partly exposed beyond the outer circumferential edge of the polishing surface in overhanging relation thereto, the workpiece is prevented from cracking. Further, the workpiece is free of any swirling marks on its polished surface.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Next, a polishing apparatus according to an embodiment of the present invention will be described with reference to drawings.

Figure 1:
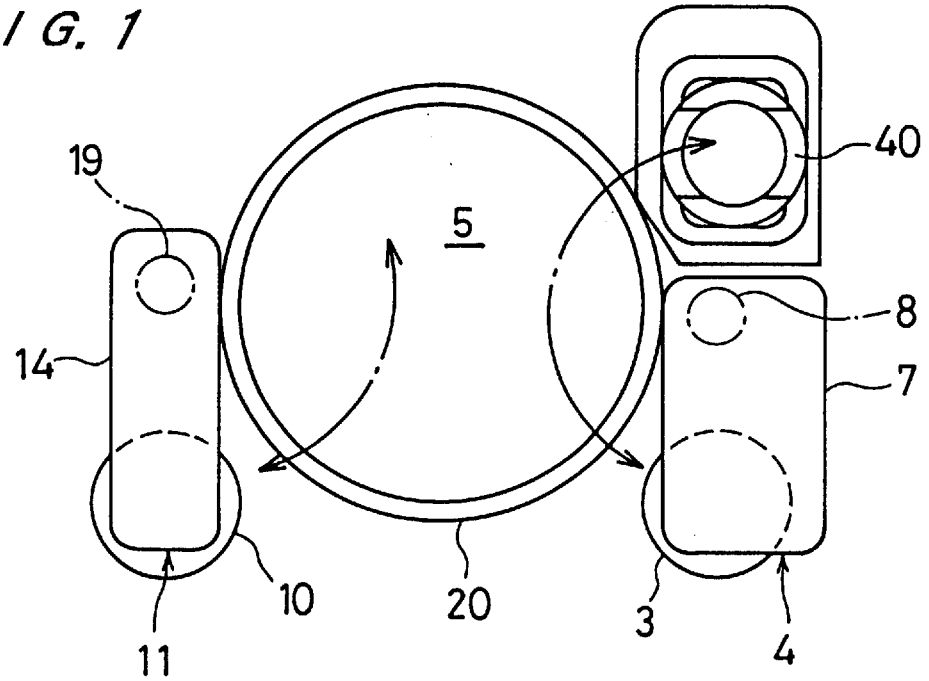
FIG. 1 is a plan view of a polishing apparatus according to an embodiment of the present invention.
Figure 2:
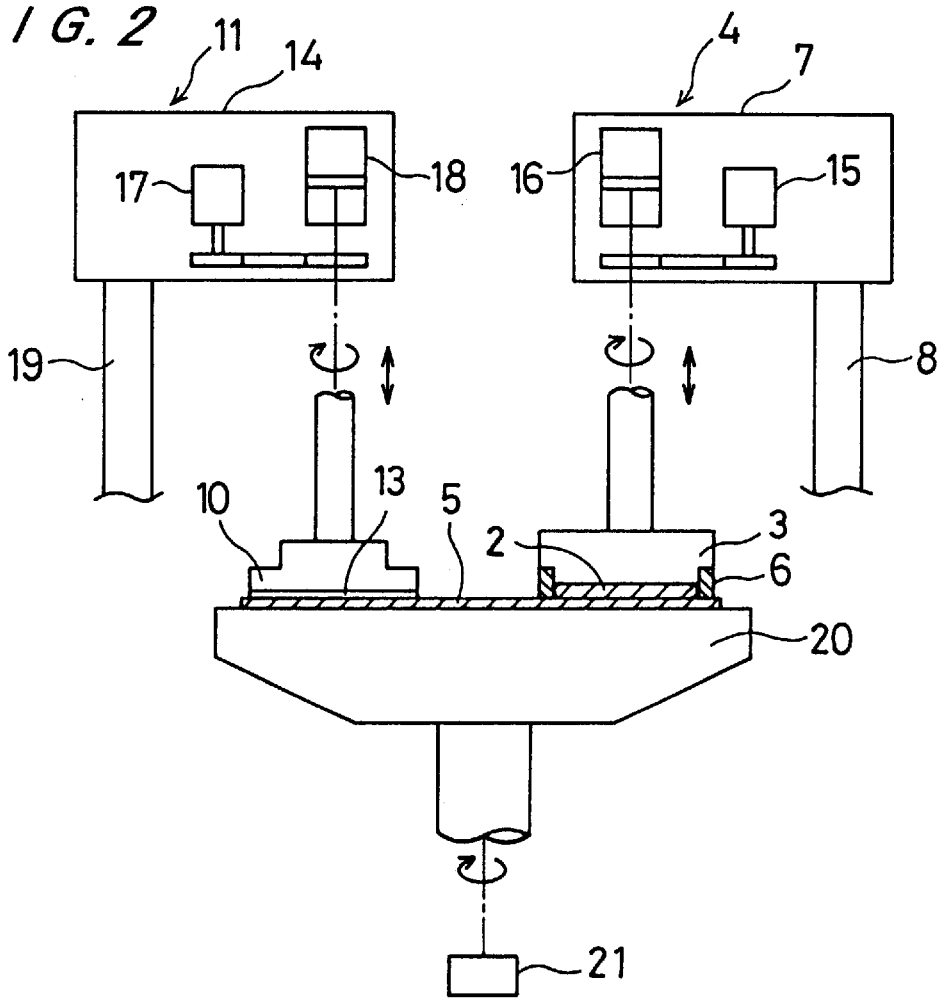
FIG. 2 is a front elevational view of the polishing apparatus according to the embodiment of the present invention.

As shown in FIGS. 1 and 2, a polishing apparatus comprises a turntable 20 and a top ring unit 4 having a top ring 3 for holding a semiconductor wafer 2 and pressing the semiconductor wafer 2 against the turntable 20. The turntable 20 has a vertical shaft coupled to a motor 21 and is rotatable about a vertical axis of the turntable 20 as shown by an arrow. A polishing cloth 5 made of, for example, IC-1000 manufactured by Rodel, Inc., is attached to the upper surface of the turntable 20. The polishing cloth 5 has an upper polishing surface held in sliding contact with the semiconductor wafer 2.

The top ring unit 4 has an arm-shaped top ring head 7 which has a forward end portion supporting the top ring 3, and a proximal end portion supported by a swing shaft 8. By rotating the swing shaft 8 about its vertical axis, the top ring head 7 is swingable in a horizontal plane. As a result, the top ring 3 can be positioned at a transfer position located above a pusher 40 and transferring the semiconductor wafer 2 between the top ring 3 and the pusher 40, a polishing position on the turntable 20, and a standby position shown in FIG. 1 off the turntable 20. The top ring 3 is coupled to a motor 15 and a lifting/lowering cylinder 16. Thus, the top ring 3 can be vertically moved by the lifting/lowering cylinder 16 and can also be rotated about its own axis by the motor 15 as indicated by the arrows. When the top ring 3 is lowered toward the turntable 20, the top ring 3 presses the semiconductor wafer 2 against the polishing cloth 5 on the turntable 20 under a given pressure. The top ring 3 has an attracting mechanism (not shown) for attracting the semiconductor wafer 2 to its lower surface under a vacuum. A guide ring 6 is mounted on a lower outer circumferential surface of the top rind 3 to prevent the semiconductor wafer from being dislodged. An abrasive liquid is supplied to the polishing cloth 5 on the turntable 20 by an abrasive liquid nozzle (not shown) which is positioned above the turntable 20.

After the semiconductor wafer 2 is polished, the semiconductor wafer 2 is removed from the polishing cloth 5. At this time, in order to reduce the surface tension between the semiconductor wafer 2 and the polishing cloth 5, the top ring 3 which holds the semiconductor wafer 2 is horizontally displaced to a position where the polished surface of the semiconductor wafer 2 is partly exposed beyond the outer circumferential edge of the polishing cloth 5 in overhanging relation thereto, and then is moved upwardly to lift the semiconductor wafer 2 off the polishing cloth 5. The semiconductor wafer 2 may similarly be displaced to the overhanging position when the polished surface is to be inspected during the polishing process. However, when the semiconductor wafer 2 is displaced to the overhanging position, the top ring 3 holding the semiconductor wafer 2 rides onto an annular step on the polishing cloth 5 along the outer circumferential edge thereof, thus causing the semiconductor wafer 2 to crack by collision with the annular step.

Figure 3A:
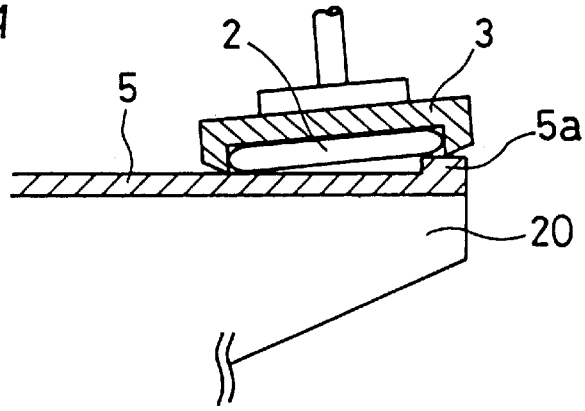
FIGS. 3A, 3B and 3C are fragmentary cross-sectional, perspective, and plan views, respectively, showing the relationship between a top ring holding a semiconductor wafer and a polishing cloth on a turntable.
Figure 3B:
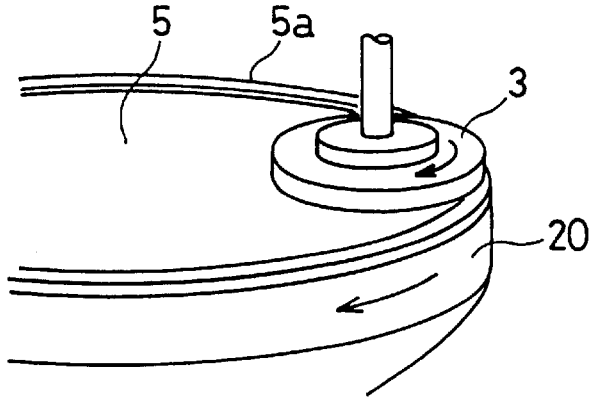
Figure 3C:
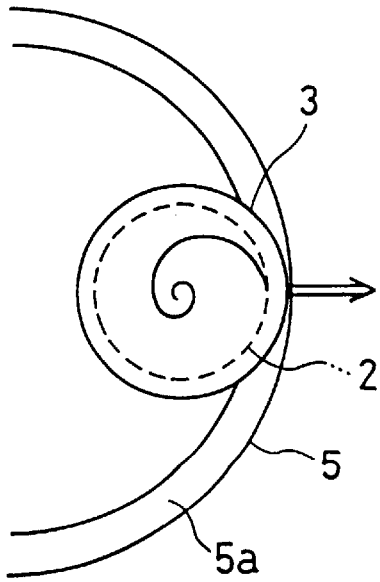

FIGS. 3A, 3B and 3C of the accompanying drawings show the mechanism by which the above phenomenon occurs. As shown in FIG. 3A, the polishing cloth 5 on the turntable 20 has an annular step 5*a* produced by repeated dressing along an outer circumferential edge thereof. When the top ring 3 holding the semiconductor wafer 2 is horizontally displaced radially outwardly to the outer circumferential edge of the polishing cloth 5, the top ring 3 and hence the semiconductor wafer 2 ride onto the step 5*a*. At this time, the semiconductor wafer 2 tends to crack under a load applied from the step 5*a*. As shown in FIG. 3B, the turntable 20 and the top ring 3 rotate in the same direction about their respective axes. It has been confirmed that when the semiconductor wafer 2 rides onto the step 5*a*, a swirling mark is formed on the polished surface of the semiconductor wafer 2 by the step 5*a* that underlies the semiconductor wafer 2. This is because when the semiconductor wafer 2 is displaced radially outwardly of the polishing cloth 5 while the semiconductor wafer 2 is rotated, the point of contact between the semiconductor wafer 2 and the step 5*a* moves radially inwardly from the outer circumferential edge toward the center of the semiconductor wafer 2 along a swirling path. Thus, the swirling path is left as the swirling mark on the polished surface of the semiconductor wafer, as shown in FIG. 3C.

As shown in FIGS. 1 and 2, the polishing apparatus has a dressing unit 11 having a dresser 10. The dressing unit 11 has an arm-shaped dresser head 14 which has a forward end portion supporting the dresser 10 and a proximal end portion supported by a swing shaft 19. By rotating the swing shaft 19 about its vertical axis, the dressing unit 11 is swingable in a horizontal plane. As a result, the dresser 10 can be positional at a dressing position over the turntable 20 and a standby position shown in FIG. 1 off the turntable 20. As shown in FIG. 2, the dresser 10 is coupled to a motor 17 and a lifting/lowering cylinder 18. The dresser 10 can be vertically moved by the lifting/lowering cylinder 18 and can also be rotated about its own axis by the motor 17 as indicated by the arrows.

Figure 4A:
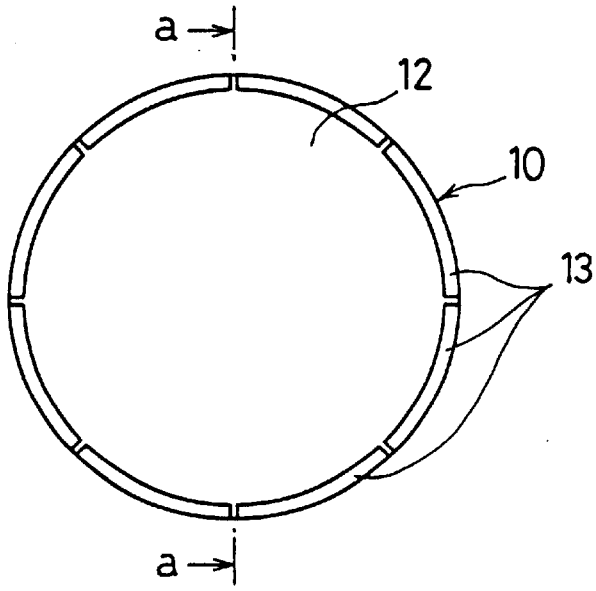
FIG. 4A is a plan view of a dresser of the polishing apparatus according to the embodiment of the present invention.
Figure 4B:
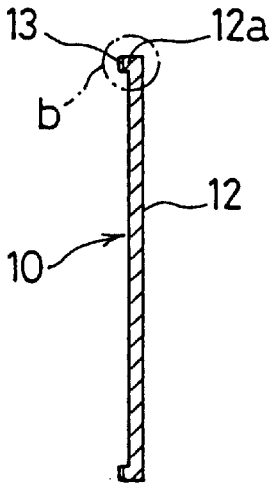
FIG. 4B is a cross-sectional view taken along line a—a of FIG. 4A.
Figure 4C:
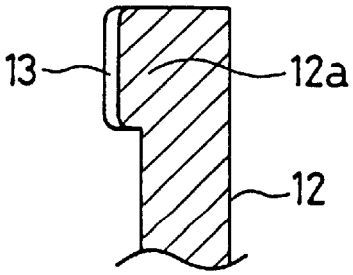
FIG. 4C is an enlarged fragmentary view of an encircled portion b in FIG. 4B.

FIGS. 4A, 4B and 4C show the dresser 10 in detail. As shown in FIGS. 4A through 4C, the dresser 10 comprises a dresser disk 12 having an annular ridge 12*a* with a given width disposed on and extending around a lower outer circumferential edge thereof. A ring 13 made of electrodeposited fine particles of diamond is mounted on the lower surface of the annular ridge 12*a*. The ring 13 is produced by applying fine particles of diamond to the surface of the ridge 12*a*, and plating the applied fine particles of diamond with nickel, thus fixing the fine particles of diamond in the plated layer of nickel. While the turntable 20 and the dresser 10 are being rotated, the ring 13 is held against the polishing surface of the polishing cloth 5 to scrape a thin layer off the polishing cloth 5, thereby dressing the polishing cloth 5.

The electrodeposited-diamond ring 13 is divided into a plurality of (eight in the illustrated embodiment) equal arcuate segments. The dresser disk 12 is larger in diameter than the semiconductor wafer 2 such that when the semiconductor wafer 2 is polished, the dressed area of the polishing cloth 5 has marginal portions with respect to the polished surface of the semiconductor wafer 2 in radially inward and outward directions of the turntable 20. The dresser 10 with the electrodeposited-diamond ring 13 may be replaced with a nylon brush whose bristles extend perpendicularly to the plane of the polishing cloth 5, or a silicon carbide dresser comprising a ring divided into a plurality of arcuate segments made of silicon carbide (SiC). The silicon carbide dresser is of the same structure as the dresser 10 shown in FIGS. 4A through 4C, and has a number of pyramidal protrusions having a height of several tens $\mu$m on its surface.

Figure 5A:
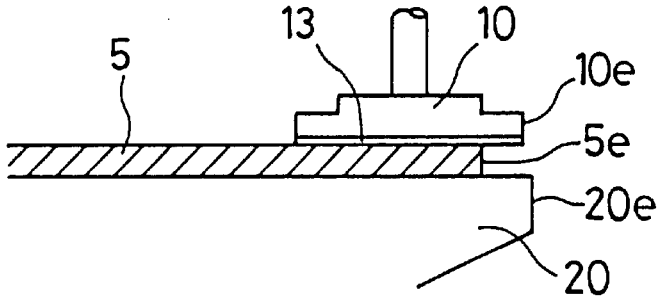
FIG. 5A is a fragmentary cross-sectional view showing the relationship between the polishing cloth and the dresser.
Figure 5B:
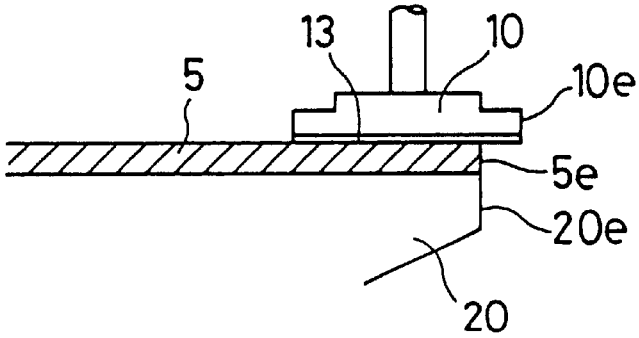
FIG. 5B is a fragmentary cross-sectional view showing the relationship between the polishing cloth and the dresser.

FIGS. 5A and 5B show the relationship between the polishing cloth 5 and the dresser 10.

In an example shown in FIG. 5A, the polishing cloth 5 has its outer circumferential edge portion entirely cut off to provide an outer circumferential edge 5*e* that is positioned radially inwardly of the outer circumferential edge 10*e* of the dresser 10, i.e., radially inwardly of the outer circumferential edge of the electrodeposited-diamond ring 13 in the radial direction of the turntable 20.

In another example shown in FIG. 5B, the polishing cloth 5 has its outer circumferential edge 5*e* substantially vertically aligned with the outer circumferential edge 20*e* of the turntable 20. The dresser 10 has an increased outer diameter to position the outer circumferential edge 5*e* of the polishing cloth 5 radially inwardly of the outer circumferential edge 10*e* of the dresser 10, i.e., radially inwardly of the outer circumferential edge of the electrodeposited-diamond ring 13 in the radial direction of the turntable 20.

Figure 6:
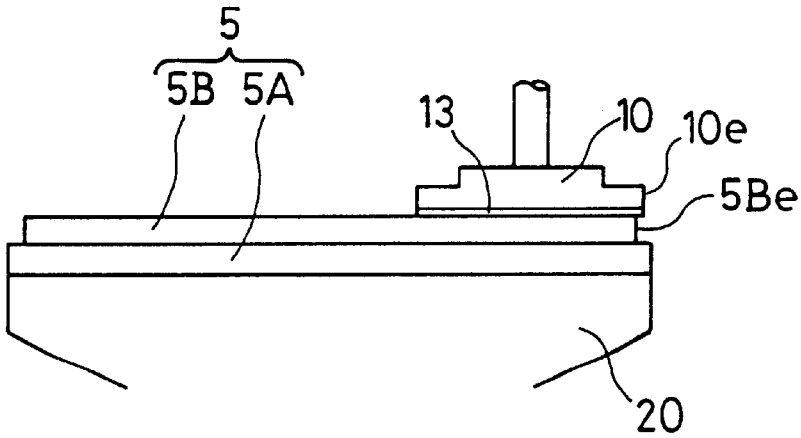
FIG. 6 is a fragmentary cross-sectional view showing the relationship between the polishing cloth and the dresser.

FIG. 6 shows still another example showing the relationship between the polishing cloth 5 and the dresser 10. As shown in FIG. 6, the polishing cloth 5 comprises a two-layer polishing cloth including a first lower layer 5A made of nonwoven fabric impregnated with urethane resin (e.g., SUBA800), and a second upper layer 5B made of polyurethane foam (e.g., IC-1000). The second upper layer 5B has its outer circumferential edge portion entirely cut off to provide an outer circumferential edge 5Be that is positioned radially inwardly of the outer circumferential edge 10*e* of the dresser 10, i.e., radially inwardly of the outer circumferential edge of the electrodeposited-diamond ring 13 in the radial direction of the turntable 20.

In FIGS. 5A, 5B and 6, the dresser 10 is rotatable about its own vertical axis, but immovable on the polishing cloth 5 in the radial direction of the polishing cloth 5 during the dressing process. In other words, the dresser is not swingable over-the polishing cloth 5 during the dressing process. As shown in FIGS. 5A, 5B, and 6, the polishing cloth 5 is cut off to a shape whose outer circumferential edge is positioned radially inwardly of the outer circumferential edge 10*e* of the dresser 10, or the dresser 10 has an increased outer diameter so as to dress the polishing cloth 5 including its outer circumferential edge completely. Therefore, the polishing cloth 5 is dressed uniformly over its entire polishing surface without forming steps thereon. Therefore, when the polished semiconductor wafer 2 is horizontally displaced to a position where the polished surface of the semiconductor wafer 2 is partly exposed beyond the outer circumferential edge 5*e* of the polishing cloth 5, the semiconductor wafer 2 is prevented from cracking. Further, when the polished semiconductor wafer 2 is horizontally displaced to the overhanging position, the semiconductor wafer 2 is free of any swirling marks on its polished surface.

In FIGS. 5A, 5B, and 6, the outer circumferential edge 5*e*, 5Be of the polishing cloth 5 is positioned radially inwardly of the outer circumferential edge of the electrodeposited-diamond ring 13 in the radial direction of the turntable 20. However, the outer circumferential edge of the electrodeposited-diamond ring 13 and the outer circumferential edge of the polishing cloth 5 may be aligned with each other in the radial direction of the turntable 20.

With this modification, the polishing cloth 5 has its polishing surface free of steps when it is dressed by the dresser 10.

Next, the positional relationship between the top ring and the dresser, and the polishing surface on the turntable will be described in detail with reference to FIG. 7.

Figure 7:
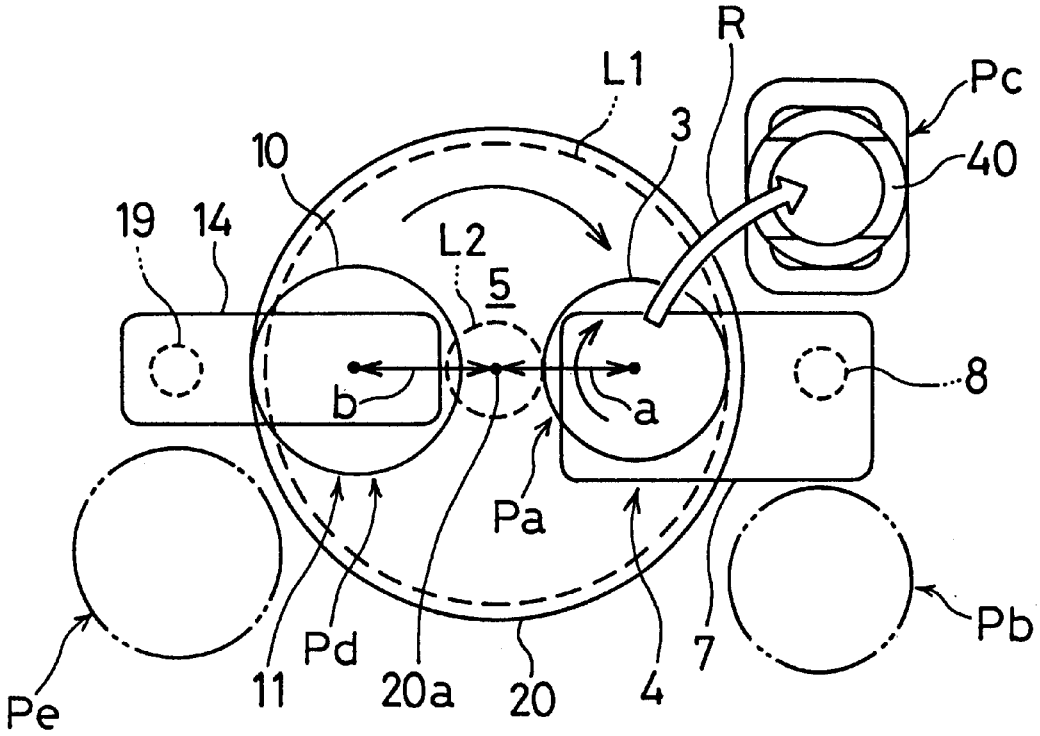
FIG. 7 is a schematic view showing the relationship between the top ring and the dresser, and the polishing surface on the turntable.

As shown in FIG. 7, the polishing position semiconductor wafer 2 by the top ring 3 and the dressing position by the dresser 10 are diametrically symmetrical with respect to a center 20*a* of the turntable 20. In FIG. 7, operational positions of the tip ring 3 and the dresser 10 are shown by solid lines, respectively, for convenience of illustration. However, the polishing process by the top ring 3 and the dressing process by the dress 10 may be carried out at the dame time or at different times. The distance a between the center 20*a* of the turntable 20 and the center of the semiconductor wafer 2 during polishing is equal to the distance b between the center 20*a* of the turntable 20 and the center of the dresser 10 during dressing. The top ring 3 and the dresser 10 are not movable, respectively, in a radial direction of the turntable 20 during polishing or dressing. Since the top ring 3 and the dresser 10 are positioned at the same distance from the center 20*a* of the turntable 20 in a radial direction, operational conditions of polishing and dressing can be easily regulated in consideration of both of the polishing process and the dressing process.

In the present invention, the diameter of the dresser 10 is larger than that of the semiconductor wafer 2, and hence an area wider than the area used for polishing the semiconductor wafer 2 and corresponding to the area between the outer circle line L1 and the inner circle line L2 on the polishing cloth 5 can be dressed. Thus, even if the dresser 10 is not swung in a horizontal plane during dressing, the area on the polishing cloth 5 which contacts the semiconductor wafer 2 can be uniformly planarized, and the suitable conditioning can be performed. The polishing cloth 5 is dressed by the dresser 10 up to its outer circumferential edge so that a nonuniform load is not applied to the semiconductor wafer 2 during an overhanging action. That is, the outer circumferential edge of the dresser 10 and the outer circumferential edge of the polishing cloth 5 may be aligned with each other, or the outer circumferential edge of the dresser may be projected from the outer circumferential edge of the polishing cloth 5 by several centimeters.

In the polishing apparatus according to the present invention, the top ring unit 4 (i.e., top ring head 7) is swingable about the swing shaft 8 in a horizontal plane between the working position Pa and the standby positions Pb. The top ring unit 4 is also movable to the transfer position Pc of the semiconductor wafer 2 above the pusher 40. The dressing unit 11 (i.e., dresser head 14) is swingable about the swing shaft 19 in a horizontal plane between the working position Pd and the standby position Pe.

Since the top ring unit 4 and the dressing unit 11 are swingable about the swing shafts 8, 19, respectively, and the swing shafts 8, 19 are disposed near the turntable 20, even if the top ring 3 and the dresser 10 are movable as stated above, the entire structure of the polishing apparatus may be compact to thus save installation space of the polishing apparatus. Further, the top ring 3 and the dresser 10 have respective working areas and respective moving areas which do not overlap each other, and the swing shafts 8, 19 are disposed in a diametrically opposite relationship. Thus, the top ring 3 and the dresser 10 do not interfere with each other in their working positions, standby positions and moving paths. Consequently, the top ring 3 and the dresser 10 can be operated independently and freely, taking no account of mutual operational conditions.

The overhanging action of the top ring 3 is performed in a direction shown by an arrow R. The turntable 20 and the top ring 3 are rotated about their own axes in the same direction (clockwise direction in the illustrated embodiment). The overhanging action of the top ring is performed by swing motion of the top ring 3 in the same direction as the rotations of the top ring 3 and the turntable 20. Since the rotational directions of the top ring 3 and the turntable 20, and the swinging direction of the top ring 3 in the overhanging action are the same (clockwise direction in the illustrated embodiment), during swing motion of the top ring 3, the top ring 3 is moved in the same direction as the rotational direction of the polishing cloth 5, and hence an excess load is not applied to the polishing cloth to thus prevent the surface of the polishing cloth 5 from being roughened.

Further, after polishing, the top ring 3 performs an overhanging action in a direction in which the top ring 3 approaches the pusher 40, and hence cycle time for transferring the semniconductor wafer 2 can be reduced.

Figure 8:
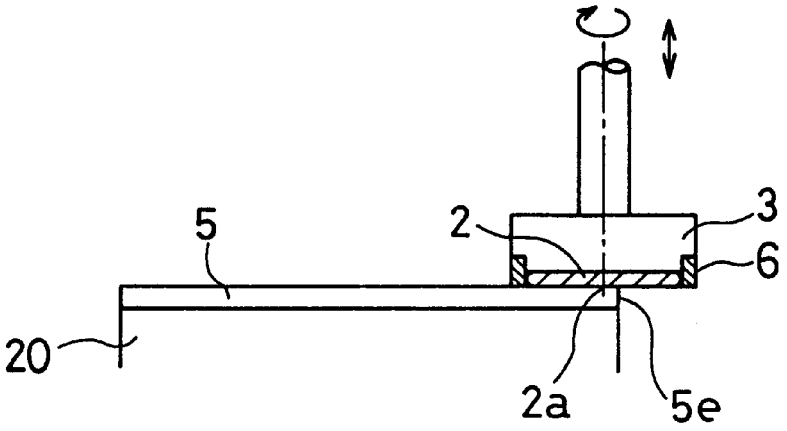
FIG. 8 is a schematic view showing an overhanging operation of the top ring.

FIG. 8 shows an overhanging action of the top ring. As shown in FIG. 8, the overhanging action is performed in such a manner that the center 2*a* of the semiconductor wafer 2 does not project from the outer circumferential edge 5*e* of the polishing cloth 5 and the polished surface of the semiconductor wafer 2 is exposed as much as possible, and then the top ring 3 holding the semiconductor wafer 2 is raised.

The polished surface of the semiconductor wafer 2 is preferably exposed over not less than 40% of the polished area and with its center 2*a* being left on the polishing cloth 5, and then the top ring 3 is raised. If the center 2*a* of the semiconductor wafer 2 projects from the outer circumferential edge 5*e* of the polishing cloth 5, then the top ring 3 is inclined to affect the semiconductor wafer adversely.

The dresser 10 is operated in the same manner as the top ring 3. The top ring 3 and the dresser 10 are swung from their respective standby positions to their respective working positions above the polishing surface, and then lowered, respectively to contact the polishing surface of the polishing cloth 5. After completing polishing or dressing, the top ring 3 or the dresser 10 is swung in a horizontal plane, and the top ring 3 or the dresser 10 is displaced to a position where the top ring 3 or the dresser 10 overhangs the outer circumferential edge of the polishing cloth and then raised to be separated from the polishing cloth 5. This overhanging action allows the surface tension between the polishing surface and the semiconductor wafer 2 and also the surface tension between the polishing surface and the dresser 10 to be reduced, and the semiconductor wafer and the dresser can be reliably separated or removed from the polishing surface. Further, since the polishing cloth 5 is dressed uniformly over its entire polishing surface without forming steps thereon, the semiconductor wafer 2 is prevented from being scratched. The dresser 10 has a relatively small contact area with the polishing surface, and may be raised at the working position Pd without an overhanging action.

Although certain preferred embodiments of the present invention has been shown and described in detail, it should be understood that various changes and modifications may be made therein without departing from the scope of the appended claims.

What is claimed is:

1. An apparatus for polishing a surface of a workpiece comprising:

a turntable having a polishing surface thereon;

a top ring for holding a workpiece and pressing the workpiece against said polishing surface under a given pressure to polish the workpiece;

a mechanism for moving said top ring in a horizontal plane while the workpiece is in contact with said polishing surface to project a part of a polished surface of the workpiece from said polishing surface after polishing, and then raising said top ring holding the workpiece to remove the workpiece from said polishing surface; and a dresser for dressing said polishing surface, said dresser dressing said polishing surface from an inner portion to an outer circumferential edge of said polishing surface so that a step is not formed from an area located at said inner portion of said polishing surface and used for polishing the workpiece to said outer circumferential edge of said polishing surface.

2. An apparatus according to claim 1, wherein said dresser has a diameter larger than that of the workpiece.

3. An apparatus according to claim 2, wherein aid dresser is stationary in a radial direction of said turntable during dressing.

4. An apparatus according to claim 1, wherein said turntable and said top ring are rotated in the same direction, and after polishing, said top ring is moved in the same direction as rotational directions of said turntable and said top ring.

5. An apparatus for polishing a surface of a workpiece, comprising:

a turntable having a polishing surface thereon;

a top ring for holding a workpiece and pressing the workpiece against said polishing surface under pressure to polish the workpiece;

a top ring moving mechanism to move said top ring in a horizontal plane while the workpiece is in contact with said polishing surface so as to project a part of a polished surface of the workpiece from said polishing surface after polishing and to raise said top ring while holding the workpiece so as to remove the workpiece from said polishing surface; and a dresser to dress said polishing surface, said dresser having a dressing position in which said dresser extends from an inner portion of said polishing surface to at least an outer circumferential edge of said polishing surface so as to avoid the formation of a step in an area located at the inner portion of said polishing surface.

6. The apparatus of claim 5, wherein said dresser is movable between a second position in which said dresser is out of contact with said polishing surface and said dressing position in which said dresser contacts said polishing surface.

7. The apparatus of claim 5, wherein said dresser extends from said inner side of said polishing surface past said outer circumferential edge of said polishing surface.

8. The apparatus of claim 5, wherein said dresser has a diameter larger than that of the workpiece.

9. The apparatus of claim 8, wherein said dresser is radially fixed with respect to said turntable in said dressing position.

* * * * *

UNITED STATES PATENT AND TRADEMARK OFFICE

CERTIFICATE OF CORRECTION

PATENT NO. : 6,354,918 B1
DATED : March 12, 2002
INVENTOR(S) : Tetsuji Togawa et al.

It is certified that error appears in the above-identified patent and that said Letters Patent is hereby corrected as shown below:

Column 9,
Line 1, please change “aid” to -- said --.

Signed and Sealed this

Fourth Day of June, 2002

*Attest:*

*Attesting Officer*

JAMES E. ROGAN
*Director of the United States Patent and Trademark Office*